US005259170A

United States Patent [19]

Tolson

[11] Patent Number: 5,259,170

[45] Date of Patent: Nov. 9, 1993

[54] APPARATUS AND METHOD FOR STRETCHING OF WRAPPING FILM

[75] Inventor: Sidney S. Tolson, Scotland Neck, N.C.

[73] Assignee: Ossid Corporation, Rocky Mount, N.C.

[21] Appl. No.: 901,184

[22] Filed: Jun. 19, 1972

[51] Int. Cl.[5] ..... B65B 11/20

[52] U.S. Cl. ..... 53/441; 53/461; 53/556; 53/209

[58] Field of Search ..... 53/441, 450, 209, 550, 53/556, 461

[56] References Cited

U.S. PATENT DOCUMENTS

| | | | |
|---|---|---|---|
| 3,517,479 | 6/1970 | Pinkham | 53/550 |
| 4,553,373 | 11/1985 | Viitanen | 53/441 |
| 4,571,927 | 2/1986 | Suga | 53/209 X |
| 4,841,715 | 6/1989 | Suga | 53/556 X |

*Primary Examiner*—John Sipos
*Attorney, Agent, or Firm*—Olive & Olive

[57] ABSTRACT

An improvement to the conventional apparatus and method for wrapping products and product trays with a film is provided. As the wrapping film is carried over and with the product by chains fitted with gripper clamps, a set of guiding rollers is brought into contact with the film to maintain the film substantially horizontal between the rollers and the grippers. The apparatus described also permits stretching of the film to minimize wrinkles and maximize film utilization.

4 Claims, 3 Drawing Sheets

APPARATUS AND METHOD FOR STRETCHING OF WRAPPING FILM

FIELD OF THE INVENTION

The invention disclosed relates to the field of automatic wrapping apparatus and methods of wrapping and more particularly to the handling of film in such apparatus and method.

BACKGROUND OF THE INVENTION

Many products are packaged in trays which are overwrapped with a clear plastic film. The clarity of the film adds to the market appeal and ultimate commercial success of the product. It is also important for a package to be wrapped so that the plastic film is smooth in appearance, rather than wrinkled, in order to optimize the consumer appeal of the product. These basic sales concepts apply to packages wrapped in either heat shrinkable or stretch-wrap film, either of which may be employed for wrapping of product-filled trays.

A packaging apparatus which is representative of the state of the art is taught in U.S. Pat. No. 4,841,715 to Suga. The '715 patent discloses an apparatus having a pair of chains which run along opposite sides of a path of transport of the article to be wrapped. The chains carry a number of grippers, or clamps, which are adapted to firmly grasp each edge of a wrapping film. The grippers operate to place the film over the article being wrapped and pull the edges of the film downwardly in the widthwise direction so as to minimize wrinkles. The width between the pair of chains is adjustable according to the basic size of the film and whether the film is of the heat shrinkable or stretch-wrap type. The teachings of the '715 patent are incorporated herein by reference.

A significant limitation of the '715 patent apparatus to which the present invention is directed relates to the amount of stretch which can be placed on the film. In the '715 patent apparatus, the grippers used comprise two parallel horizontal plates biased so as to firmly grip a wrapping film when the film is placed between the plates and the plates closed. The film is brought downwardly upon the article being wrapped and is pulled further down as the film wraps around the article. In practice, the downward pull of the grippers on the film results in an upward pull of the film upon the grippers, which upward pull tends to either tear the film or open the grippers and release the film. Therefore, the amount of stretch which may be placed on the film is limited by the holding strength of the grippers and the tensile strength of the film.

It is useful to be able to stretch a wrapping film to a greater degree than is possible with the '715 patent apparatus. One reason for greater stretch is to be able to remove wrinkles as much as possible during the wrapping process. Another reason is to be able to use and stretch heavier gauge films, which heavier films will better protect the article being wrapped. An additional reason is to be able to stretch the film widthwise and thereby obtain an effectively wider film for the cost of a narrower film.

Therefore, the foregoing define objectives of the invention as will be apparent in the disclosure that follows.

SUMMARY OF THE INVENTION

The present invention provides an improvement of known equipment for the packaging of products in trays which are to be overwrapped with a sealable film. The apparatus and method of the invention applies equally to stretch wrap and heat shrinkable films. A set of cooperating rollers on each side of the path of the wrapping film are arranged so as to engage opposite portions of the film in a location intermediate the product-laden tray and a pair of laterally disposed film-carrying gripper chains. The sets of rollers operate to maintain the edges of the film at substantially the same level as that of the grippers as the film descends relative to the product and tray. The roller sets comprise two large diameter upper rollers above the film and one smaller diameter roller below the film which rollers are adjusted so as to keep the film parallel to the downward movement of the grippers. The rollers are individually adjustable so as to enable variation of the degree of pressure on the film as well as the angle at which the film covers the loaded tray.

DESCRIPTION OF THE PREFERRED EMBODIMENT

Figure 1:
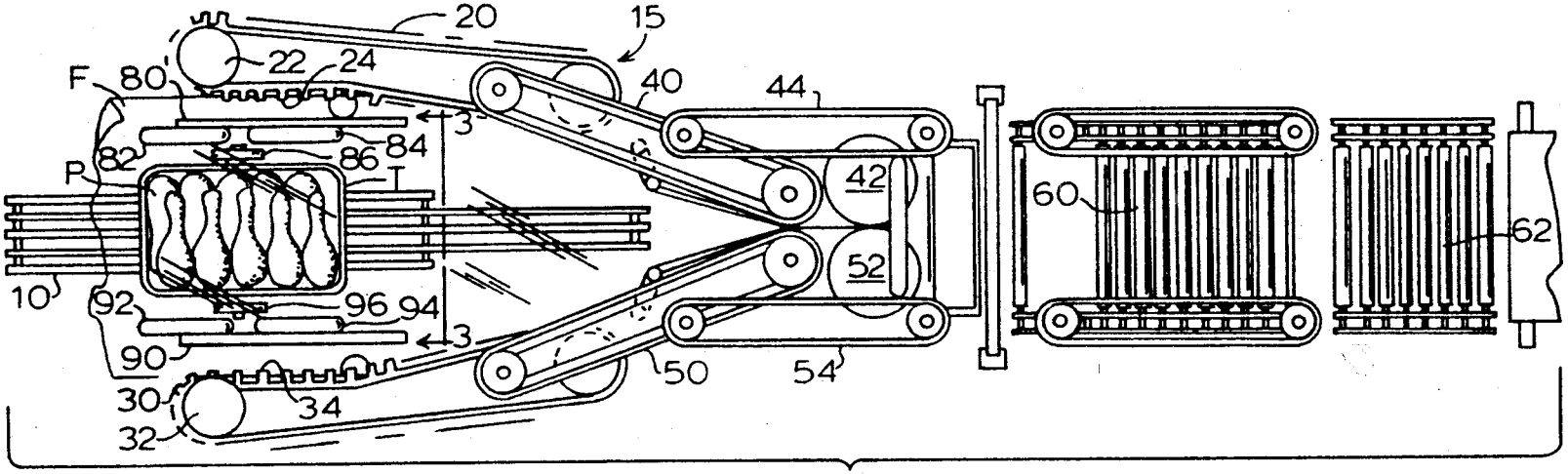
FIG. 1 is a top plan view of the first portion of a machine for wrapping a product filled tray with a flexible film, including the improvement apparatus of the present invention.
Figure 2:
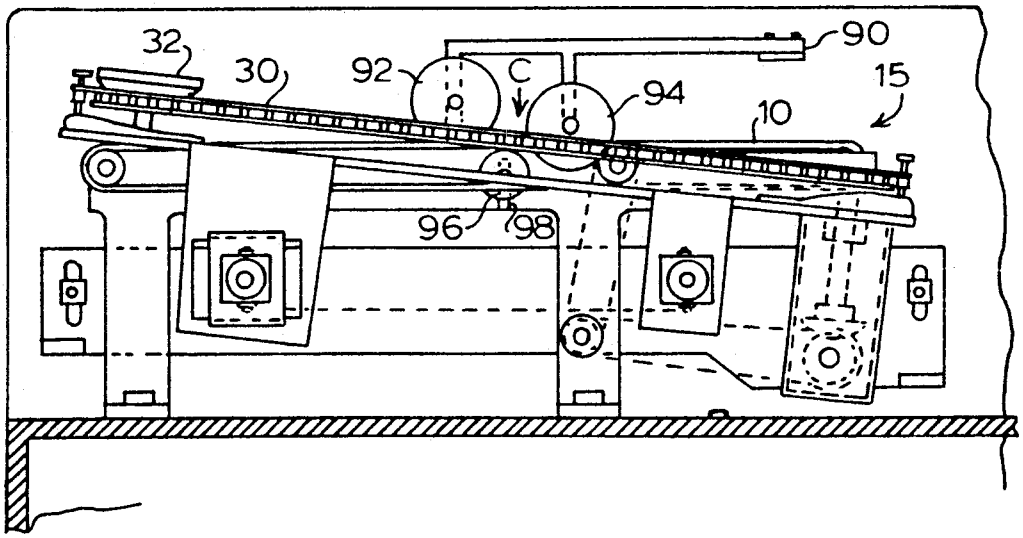
FIG. 2 is a side elevation view of the first wrapping station of the machine shown in FIG. 1 as modified by the improvement apparatus of the present invention.

FIGS. 1 and 2 illustrate a portion of a film wrapping machine 15 of the type disclosed in the '715 patent to Suga and incorporating the apparatus of the present invention. The illustrations focus on the first, or wrapping, station of the machine 15 wherein the tray T filled with product P is progressively surrounded by a tubular formation of film F. Film F as used herein may be either of the heat shrinkable or stretch wrap type.

As film F is supplied to the wrapping machine 15 from a supply roll (not shown), each edge of film F is engaged by a series of grippers 24, 34 mounted respectively on chains 20, 30 on either side of film F. Grippers 24, 34 firmly grasp the opposite edges of film F and move film F along a path according to the adjusted positions of chains 20, 30. Chains 20, 30 are substantially mirror images of each other and are generally positioned according to the typical example of the preferred embodiment shown in FIGS. 1 and 2. Thus, as illustrated in FIG. 2, chains 20 and 30 follow a generally downward path as they move from left to right and both chains 20, 30 follow converging paths as seen from above in FIG. 1.

The descending, converging paths of chains 20, 30 serve to wrap film F around the substantially horizontal conveyor 10 and any product P in tray T being transported thereby. A critical crossing point C is where the chains 20, 30 (FIG. 2) pass below horizontal conveyor 10 as the chains move downwardly and the film F begins to be stressed against product P filled tray T.

Figure 4:
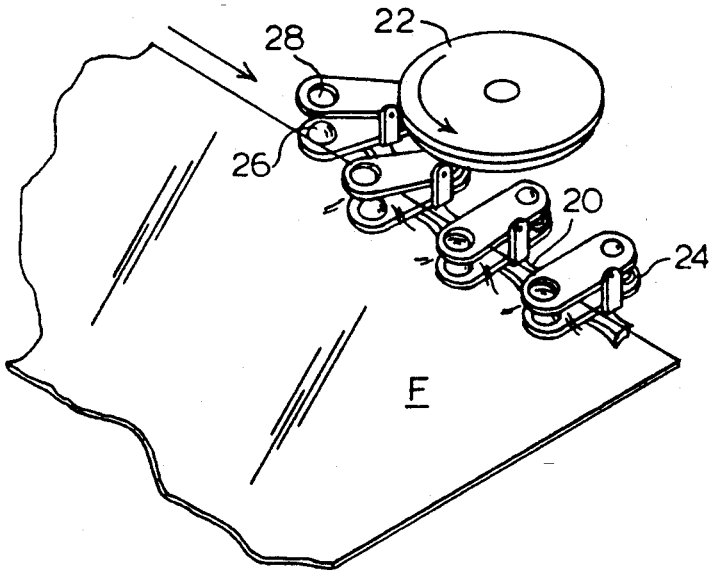
FIG. 4 is a perspective partial view of the gripper chain of the known wrapping machine with a series of grippers shown engaging a section of wrapping film.

As described in the '715 patent and illustrated in FIG. 4, grippers 24 are carried by chain 20 and are automatically opened by a downward pressure exerted by cam plate 22 as each gripper passes thereby. When individual grippers 24 exit from beneath cam plate 22 the downward pressure of cam plate 22 is released and allows a spring (not shown) in each gripper 24 to close the upper plate against the lower plate to grasp film F. The same action occurs on the opposite side of the machine between film F, grippers 34 and cam plate 32 (FIG. 1). The lower plates of grippers 24 as seen in FIG. 4, each have a semispherical frictional member 26 mounted so as to enter a mating hole 28 in each respective upper plate. These interengaging semispherical members 26 and mating holes 28 act to increase the frictional grip on film F and therefore the possible stress which may be applied to film F.

Figure 3A:
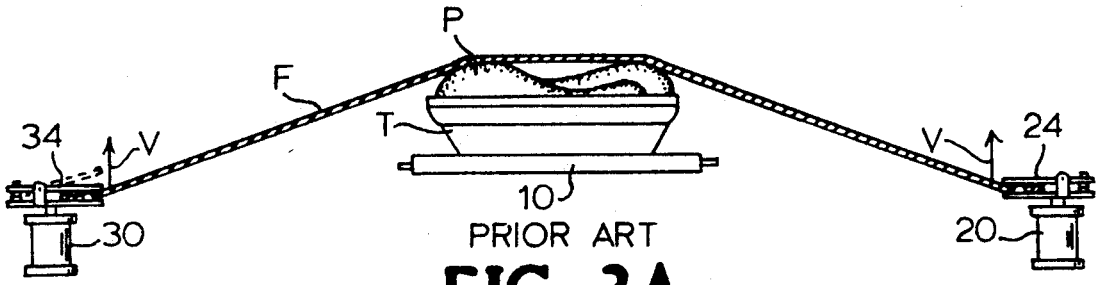
FIG. 3A is a partial elevation view taken in the direction of line 3—3 of FIG. 1 and showing a film being wrapped over a filled tray and tensioned according to the prior art, the thickness and width of the film illustrated being exaggerated for clarity.

FIG. 3A illustrates the relative positions of product P and grippers 24, 34 and the angles formed by film F in the prior art machine at a point along the path of travel somewhat beyond conveyor crossing point C of FIG. 1. Without the improvement afforded by the present invention, a situation similar to that illustrated in FIG. 3A poses difficulties. As conveyor 10 moves tray T horizontally and perpendicular to the plane of the FIG. 3A drawing and as chains 20, 30 carry grippers 24, 34 downwardly, film F becomes increasingly more stretched. As grippers 24, 34 impart tension to film F, film F imparts an upward reaction force V on the openable upper plates of grippers 24, 34. This upward force V could, and often does, lift the upper plates of grippers 24, 34 (shown in dashed lines in FIG. 3A), thereby causing grippers 24, 34 to release their hold on film F. If the spring pressure applied to keep grippers 24, 34 closed is increased to overcome this tendency to open, the stretching force on film F is often enough to tear film F. This limitation requires, without the benefits provided by the present invention, no more than a moderate stretching of film F.

Figure 3B:
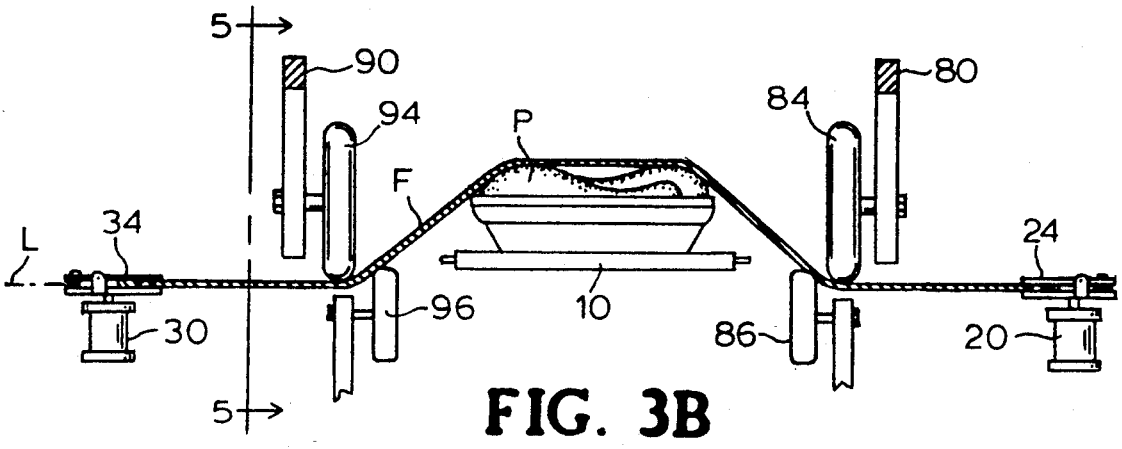
FIG. 3B is the view of FIG. 3A with the addition of the apparatus of the invention acting to control the level of the wrapping film.

The change and improvement of the invention as incorporated in the machine 15 of FIG. 1 is more specifically illustrated in front elevation in FIG. 3B. FIG. 3B shows a view of the modified wrapping machine 15 of the invention at the same point along the path of travel as the view of FIG. 3A, with the addition, according to the invention, of a pair of opposed guide means configured as a first set of film aligning rollers 84, 86 and a second set of film aligning rollers 94, 96. A side elevation view in the direction of line 5—5 of FIG. 3B is portrayed in FIG. 5. An improvement to the described prior art machine could be made by use of either one or two rollers, pressing downwardly on film F on each side of tray T, however, the preferred embodiment incorporates use of a third roller on each side; e.g., roller 92 in FIG. 5. The following description which specifically describes the roller set 92, 94, 96 applies to describing the roller sets on both sides of conveyor 10.

Figure 5:
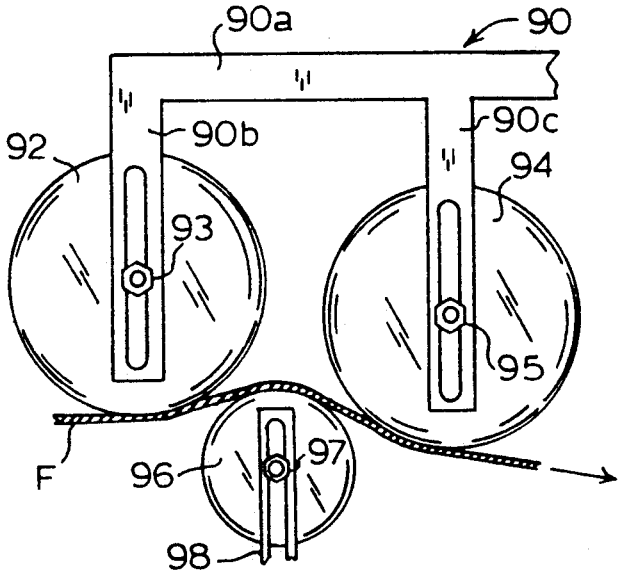
FIG. 5 is a sectional elevational view taken in the direction of line 5—5 of FIG. 3B and showing the rollers of the invention.

As film F is conveyed downwardly past and below the level of conveyor 10 by chains 20, 30 and is held by grippers 24, 34, film F passes, in the direction indicated by the arrow, between upper rollers 92, 94 and lower roller 96 (FIG. 5). Upper rollers 92, 94 press downwardly on the top of film F and lower roller 96 presses upwardly, thereby frictionally grasping film F between the two upper rollers 92, 94 and lower roller 96. Similar upper and lower roller action occurs on the opposite side of film F with rollers 82, 84, 86 (FIG. 1). Rollers 92, 94, 96 are generally made of a material, at least along their peripheral portions, which has a high surface friction when held in contact with the type of plastic film usually employed in such a wrapping process. The frictional component between rollers 92, 94, 96 and film F serves to further reduce the stress on grippers 24, 34 as rollers 92, 94, 96 stretch film F over product P. An acceptable material for all rollers is either Delrin®, made by Dupont Co., Inc. of Wilmington, Del. or polyvinyl chloride (PVC) resin when used with a film of polyolefin or of PVC as is commonly employed. The friction obtained between rollers 92, 94, 96 and film F serves to multiply the stretching force available to apply to film F as compared to that which may be accomplished with grippers alone. As the film F continues to move along its path, upper rollers 92, 94 serve to maintain the plane of the outer edges of the film F substantially aligned with the central plane L (FIG. 3B) of grippers 34 and thus relieve the upward force V indicated in the prior art arrangement of FIG. 3A. By ensuring that the outer edges of film F remain substantially in the same central plane L as the plane of the grippers 24, 34 during travel of chains 20, 30, the grippers 24, 34 keep their hold on the edges of film F without the grippers opening or the film tearing and proper control is maintained. Further, by relying on frictional guide rollers 92, 94, 96 to impart lateral tension to film F, the upward force on grippers 24, 34 is kept relatively low.

The wrapping machine 15 to which the invention pertains is adaptable to a variety of product sizes and films and for this purpose, a configuration allowing roller position adjustability is provided. As seen in FIGS. 1, 2, 3B, 5, rollers 82, 84, 92, 94 are mounted on the frame of the wrapping machine 15 by means of respective mounting brackets 80, 90 in the preferred embodiment and which are fixedly secured to suitable machine frame members. Bracket 90 has one horizontal bar **90*a* and two vertical supporting slotted bars 90*b*, 90*c* to hold each roller 92, 94. Lower roller 96 is positioned by supporting lower slotted bar 98 so as to be beneath film F as it passes through the machine 15. When properly adjusted, lower roller 96 functions to urge constant contact to a greater than tangential degree between film F and upper rollers 92, 94 and thereby increases frictional control. The same relationships and roller structure exist on the opposite side of film F with rollers 82, 84, 86**.

Rollers 92, 94, 96 are each constructed to be rotatable around a spindle which is adapted to fit through a vertical slot in the respective supporting bars and be held in place by appropriate fasteners, such as the threaded nuts 93, 95, 97 shown in FIG. 5. In this way rollers 92, 94, 96 are each vertically adjustable individually for height in relation to film F. The relative height adjustment of the rollers translates into a controllable degree of contact of film F around the circumference of each roller, and a selectable angle of descent as seen in the height difference between roller 92 and roller 94 as seen in FIG. 5 and into a selectable amount of downward pressure applied by film F against product P as seen in FIG. 3B. In addition to creating a tight, wrinkle-free film F over product P, these adjustability options offer the possibility of stretching film F so as to obtain a greater coverage than originally possibile. Therefore, it is possible to cover a greater size of product and tray than that which the film as originally purchased was capable of doing, i.e. stretching a 12-inch wide film to 14 inches wide.

Returning to FIGS. 1, 2, the chains 20, 30 of the machine 15 of the invention after passing point C (FIG. 2) continue to converge and descend below the level of conveyor 10 and in doing so, transfer control of film F to converging friction belts 40, 50 which reside below the level of conveyor 10. Belts 40, 50 continue to transport tubular film F with enclosed tray T and product P to sealing rolls 42, 52 (FIG. 1) which seal the lower mating edges of film F together to form a closed tube. At this point, side drive belts 44, 54 above conveyor 10 act to move tray T, containing product P, to further processing stations as is known.

As described, the present invention both reduces the tendency to open the grippers and also increases the available lateral extension possible by introducing intermediate frictional guide means as rollers 92, 94, 96 and comparable rollers 82, 84, 86. The invention apparatus thus permits the application of significant stretching tension to film F. In addition, the interposition of guide means, such as the described rollers, between tray T and grippers 24, 34 reduces the amount of gripping force required to be applied by grippers 24, 34 on the film F.

Whereas the details of the invention are disclosed by description of a specific preferred embodiment, such should not be construed as a limitation upon the invention, the limits of which are delineated in the claims.

What is claimed is:

1. A method of stretching a film used to wrap a product in a wrapping machine in which the film wraps downwardly around said product, the method comprising:

(a) feeding a series of products to be wrapped by means of a conveyor along a conveyor path;

(b) supplying a wrapping film from a film supply roll in an orientation so as to overlie said products;

(c) gripping the longitudinal edges of said film with a series of opposed gripers having fixed lower plates and hinged, biased upper plates;

(d) moving said series of grippers in a direction substantially angled downwardly with relation to said conveyor path so that said film first contacts, and subsequently forms a tube surrounding said products;

(e) engaging the top surface of said film with a peripheral portion of an upper roller positioned between said series of grippers and said conveyor;

(f) adjusting said upper roller relative to said film so that said film is maintained substantially coplanar with a plane oriented between the upper and lower plates of said series of grippers engaging opposite edges of said film and so that said upper roller imparts a transverse stretching tension to said film;

(g) engaging the bottom surface of said film with a lower roller axially positioned between said upper roller and said conveyor; and (h) adjusting the height of said lower roller so that said film is pressed into firm engagement with said upper roller.

2. In a film wrapping machine having a product conveyor, a pair of opposed chains travelling along paths laterally adjacent said product conveyor, each said chain carrying a plurality of film grippers adapted to be opened and closed in a manner to grasp opposite edges of said film in a substantially central plane defined by and extending between the grippers, said chains and grippers configured so as to carry said film edges along a path generally converging and descending in relation to said product conveyor so that said film forms a tube surrounding a product on said product conveyor, the improvement comprising guide means providing a set of rollers between each chain and said conveyor, at least one roller in each set positioned to engage the top surface of the film and at least one roller in each set axially positioned between said upper roller and said conveyor to engage the bottom surface of the film and each set of rollers being operative to maintain the portion of film between the set of rollers and the adjacent chain in a plane which is substantially coplanar with the central plane defined by said grippers.

3. In a film wrapping machine as claimed in claim 2 wherein each set of said rollers includes a pair of upper rollers whose axes are spaced apart lengthwise of the film and both of which rollers engage the upper surface of the film and a single lower roller whose axis is located below and between the axes of said upper rollers and which lower roller engages the lower surface of said film.

4. In a film wrapping machine as claimed in claim 3, means mounting said rollers and enabling said rollers to be adjusted relative to said film to thereby adjust the amount of tension said rollers exert on said film.

* * * * *

UNITED STATES PATENT AND TRADEMARK OFFICE

CERTIFICATE OF CORRECTION

PATENT NO. : 5,259,170

DATED : November 9, 1993

INVENTOR(S) : Sidney S. Tolson

It is certified that error appears in the above-indentified patent and that said Letters Patent is hereby corrected as shown below:

The title page should be deleted to appear as per attached title page.

Signed and Sealed this

Twelfth Day of April, 1994

*Attest:*

Bruce Lehman

BRUCE LEHMAN

*Attesting Officer*

*Commissioner of Patents and Trademarks*

United States Patent [19]

Tolson

[11] Patent Number: 5,259,170

[45] Date of Patent: Nov. 9, 1993

[54] APPARATUS AND METHOD FOR STRETCHING OF WRAPPING FILM

[75] Inventor: Sidney S. Tolson, Scotland Neck, N.C.

[73] Assignee: Ossid Corporation, Rocky Mount, N.C.

[21] Appl. No.: 901,184

[22] Filed: Jun. 19, 1972

[51] Int. Cl.[5] ..... B65B 11/20

[52] U.S. Cl. ..... 53/441; 53/461; 53/556; 53/209

[58] Field of Search ..... 53/441, 450, 209, 550, 53/556, 461

[56] References Cited

U.S. PATENT DOCUMENTS

| | | | |
|---|---|---|---|
| 3,517,479 | 6/1970 | Pinkham | 53/550 |
| 4,553,373 | 11/1985 | Viitanen | 53/441 |
| 4,571,927 | 2/1986 | Suga | 53/209 X |
| 4,841,715 | 6/1989 | Suga | 53/556 X |

*Primary Examiner*—John Sipos

*Attorney, Agent, or Firm*—Olive & Olive

[57] ABSTRACT

An improvement to the conventional apparatus and method for wrapping products and product trays with a film is provided. As the wrapping film is carried over and with the product by chains fitted with gripper clamps, a set of guiding rollers is brought into contact with the film to maintain the film substantially horizontal between the rollers and the grippers. The apparatus described also permits stretching of the film to minimize wrinkles and maximize film utilization.

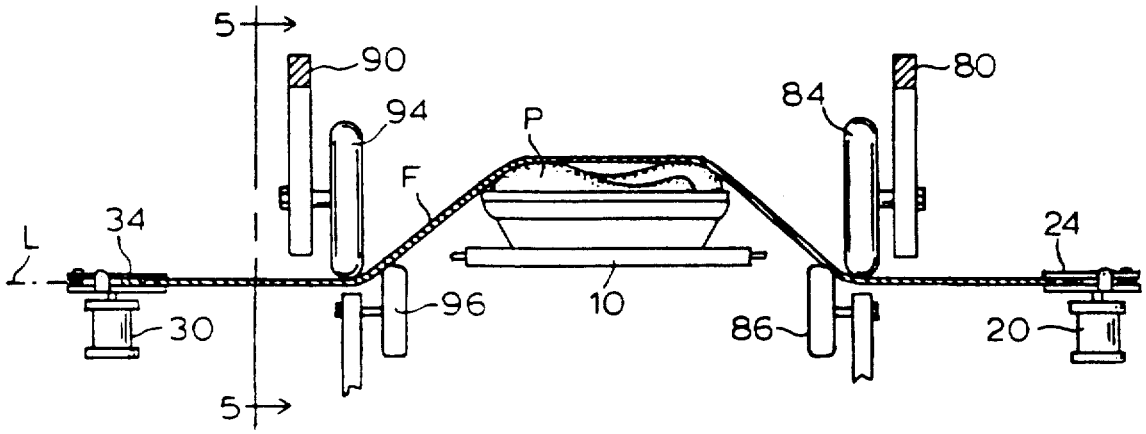

4 Claims, 3 Drawing Sheets